US006210076B1

(12) United States Patent
Haney et al.

(10) Patent No.: US 6,210,076 B1
(45) Date of Patent: Apr. 3, 2001

(54) OFFSHORE DECK INSTALLATION

(75) Inventors: James Allan Haney; Daniel Major Houser, both of Houston, TX (US)

(73) Assignee: McDermott Technology, Inc., New Orleans, LA (US)

( * ) Notice: Subject to any disclaimer, the term of this patent is extended or adjusted under 35 U.S.C. 154(b) by 0 days.

(21) Appl. No.: 09/266,422

(22) Filed: Mar. 11, 1999

Related U.S. Application Data

(63) Continuation-in-part of application No. 08/903,776, filed on Jul. 31, 1997, now Pat. No. 5,988,932.

(51) Int. Cl.[7] ..... E02D 25/00

(52) U.S. Cl. ..... 405/209; 405/195.1; 405/201; 405/203; 405/204; 405/206; 114/242; 114/264

(58) Field of Search ..... 405/195.1, 196, 405/201, 203, 206, 209; 114/258, 264, 265, 242

(56) References Cited

U.S. PATENT DOCUMENTS

| | | | | |
|---|---|---|---|---|
| H488 | * | 7/1988 | Rowan | 405/209 |
| 2,959,015 | * | 11/1960 | Beck | 405/209 |
| 4,086,777 | * | 5/1978 | Lai | 114/264 X |
| 4,683,832 | * | 8/1987 | Dysarz | 405/209 X |
| 4,729,695 | * | 3/1988 | Silvestri | 405/204 |
| 4,874,269 | * | 10/1989 | Dysarz | 405/209 |
| 5,037,241 | * | 8/1991 | Vaughn et al. | 405/209 |
| 5,097,786 | * | 3/1992 | Sheffield | 405/209 X |
| 5,183,376 | * | 2/1993 | Aralt | 405/209 X |
| 5,207,534 | * | 5/1993 | Brasted et al. | 405/209 |
| 5,219,451 | * | 6/1993 | Datta et al. | 405/204 |
| 5,403,124 | * | 4/1995 | Kocaman et al. | 405/209 |
| 5,553,977 | * | 9/1996 | Andersen et al. | 405/204 |
| 5,558,468 | * | 9/1996 | Barentt, Jr. et al. | 405/204 |
| 5,829,919 | * | 11/1998 | Heerema | 405/209 |
| 5,924,822 | * | 7/1999 | Finn et al. | 405/209 |
| 5,988,932 | * | 11/1999 | Haney et al. | 114/264 X |

FOREIGN PATENT DOCUMENTS

| | | | | |
|---|---|---|---|---|
| 2008652 | * | 6/1979 | (GB) | 405/209 |
| 1463849 | * | 3/1989 | (SU) | 405/209 |

* cited by examiner

*Primary Examiner*—Eileen D. Lillis
*Assistant Examiner*—Jong-Suk Lee
(74) *Attorney, Agent, or Firm*—D. Neil LaHaye; Robert J. Edwards

(57) ABSTRACT

A method and apparatus that eliminates the need for a derrick barge to lift the deck into place on a floating offshore structure. A connector is used to connect the transport barge to the floating offshore structure. The connector is a type that allows only relative pitch motions between the transport barge and floating offshore structure in response to sea states acting on the barge and floating offshore structure. The connector is also a type that allows disconnection while large forces are acting on the connector. One or more skidding girders attached to the legs of the deck support the legs of the deck above the skidding surface of the transport barge. A skidding surface on the girders, and complementary skidding surface on the surface of the transport barge and floating offshore structure, allow the deck to be skidded from the barge to the floating offshore structure. Once the deck is in the proper position on the floating offshore structure, the deck legs are lowered into contact with the floating offshore structure by removing spacers provided in the girders. The girders are then detached from the legs of the deck and removed. The deck may also be transferred from the transport barge to the floating offshore structure in a manner where relative pitch between the transport barge and floating offshore structure is not allowed. This is accomplished by also using a knee brace that is attached between a submerged portion of the floating offshore structure and the transport barge.

11 Claims, 9 Drawing Sheets

FIG. 4
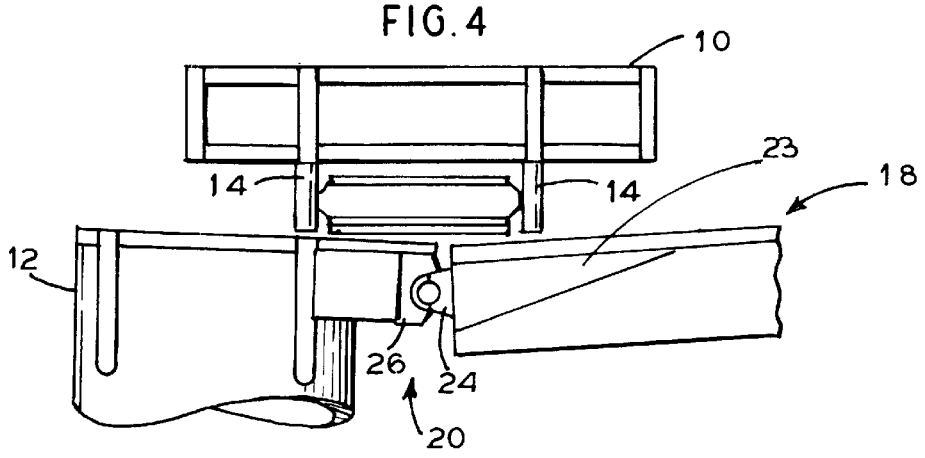
FIG. 5
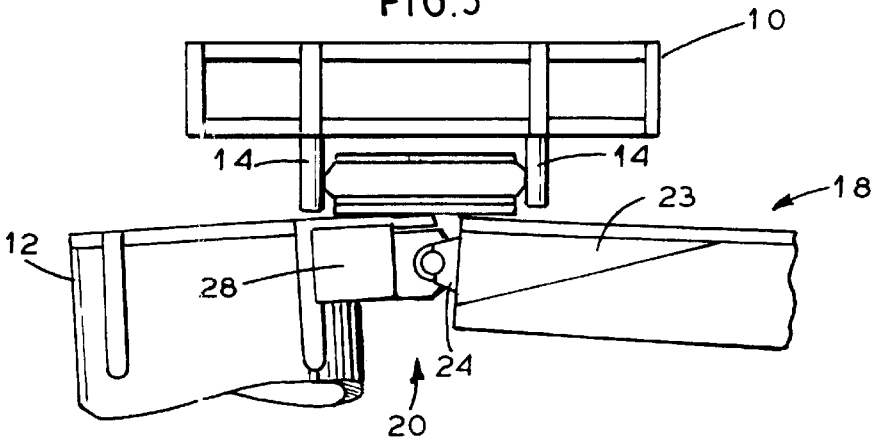
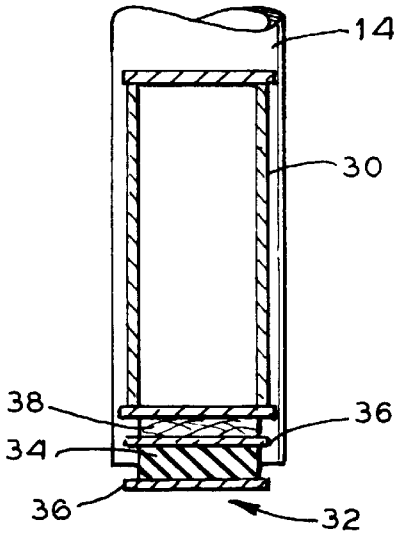
FIG. 6

OFFSHORE DECK INSTALLATION

This application is a continuation-in-part of U.S. application Ser. No. 08/903,776, filed Jul. 31, 1997, now U.S. Pat. No. 5,988,932.

BACKGROUND OF THE INVENTION

1. Field of the Invention

The invention is generally related to the load out, transportation, and installation of offshore platform decks and more particularly to the installation of a deck onto a floating offshore structure.

2. General Background

There are several methods for installing decks on offshore platforms that are well known in the industry. By far, the most common method is to build the deck onshore in a fabrication yard, lift or skid the deck onto a transport barge, transport the deck to the site on a transport barge, and lift the deck from the transport barge onto the platform substructure using a derrick barge. This is the only method that has been used to install a deck onto a spar type structure. A spar type structure may be a deep draft caisson such as that described in U.S. Pat. No. 4,702,321 or an open or truss framework such as that described in U.S. Pat. No. 5,558,467. A derrick barge is a barge with a revolving crane built into its hull. Ideally, the derrick barge that is available can make a one piece lift of the deck, so that costly hook up work offshore can be avoided. Hook up involves the connection between two or more deck units of structural, piping, electrical, and control systems. If the deck is too heavy for available equipment to lift it from the fabrication yard onto the transport barge, then the deck will be skidded along skid ways onto the transport barge in an operation know as a skidded load out.

In an effort to avoid offshore hook up work, the industry has developed methods other than lifting to install one piece decks. One or more of the alternative methods may be considered whenever a derrick barge of sufficient capacity is not available to make a one piece deck lift.

One of these methods, disclosed in U.S. Pat. No. 5,403,124, includes using a vessel having one end that is U-shaped in plan view. The deck is supported on the vessel over the U-shaped end. The vessel is then moved into position such that the U-shaped end surrounds the platform and the deck is over the offshore platform. The vessel is then ballasted down to transfer the deck onto the floating offshore platform. The width of the U-shape at the end of the vessel limits the maximum size offshore platform on which a deck can be installed by this method. Such a vessel has not been built and this method has not been used.

For a TLP (tension leg platform), the shallow draft of the structure allows it to be brought inshore to relatively shallow and protected water. This allows the deck to be built on the structure and the structure then towed to the installation site after completion.

Spar structures are typically deep draft structures that are six hundred to seven hundred feet tall and thus are incapable of being brought inshore into shallow, protected waters.

It can be seen that for spar structures, there is a need for an alternate method and apparatus for deck installation to that presently available. This need also applies in situations where the floating offshore structure and deck structures are built at different locations and it would be impractical to transport one or both to the same inshore site for installation of the deck onto the floating offshore structure.

SUMMARY OF THE INVENTION

The invention addresses the above needs. What is provided is a method and apparatus that eliminates the need for a derrick barge to lift the deck into place on the floating offshore structure. A connector is used to connect the transport barge to the floating offshore structure. The connector allows only relative pitch motions between the transport barge and floating offshore structure in response to sea states acting on the barge and floating offshore structure. The connector also allows disconnection while large forces are acting on the connector. One or more skidding girders attached to the legs of the deck support the legs of the deck above the skidding surface of the transport barge. A skidding surface on the girders, and complementary skidding surface on the surface of the transport barge and floating offshore structure, allow the deck to be skidded from the barge to the floating offshore structure. Once the deck is in the proper position on the floating offshore structure, the deck legs are lowered into contact with the floating offshore structure by removing spacers provided below the skid girders. The girders are then detached from the legs of the deck and removed. The deck may also be transferred from the transport barge to the floating offshore structure in a manner where relative pitch between the transport barge and floating offshore structure is not allowed. This is accomplished by also using a removable knee brace between the floating offshore structure and the transport barge.

BRIEF DESCRIPTION OF THE DRAWINGS

For a further understanding of the nature and objects of the present invention reference should be made to the following description, taken in conjunction with the accompanying drawings in which like parts are given like reference numerals, and wherein:

FIG. 4 is an elevation of a transport barge connected to the spar vessel with the deck skidded to a position over the connector, with a downward kink of the skidding surface due to the relative pitch being emphasized.

FIG. 5 is an elevation of the transport barge connected to the spar vessel with the deck skidded to a position over the connector, with an upward kink of the skidding surface due to the relative pitch being emphasized.

FIG. 6 is a section view through the skid girder taken along lines 6—6 of FIG. 5.

DETAILED DESCRIPTION OF THE PREFERRED EMBODIMENT

Figure 1:
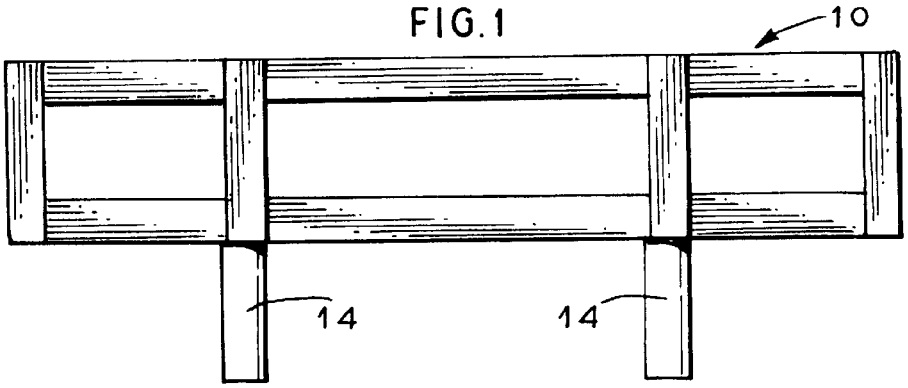
FIG. 1 is an elevation view of a frame row of a typical four-legged deck.
Figure 2:
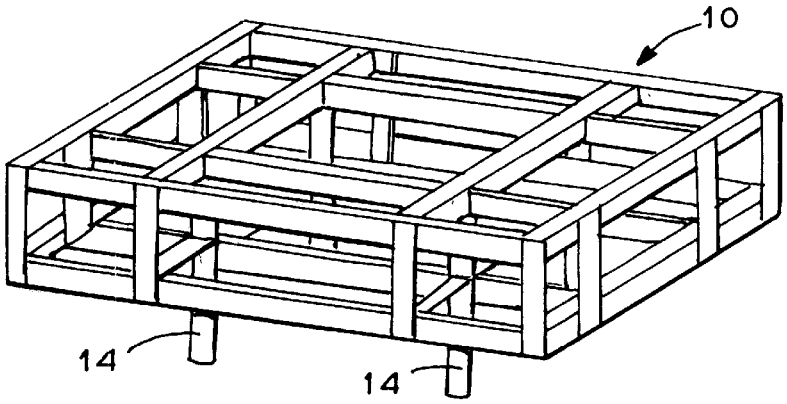
FIG. 2 is a perspective view of an orthogonally framed, four legged deck.
Figure 3:
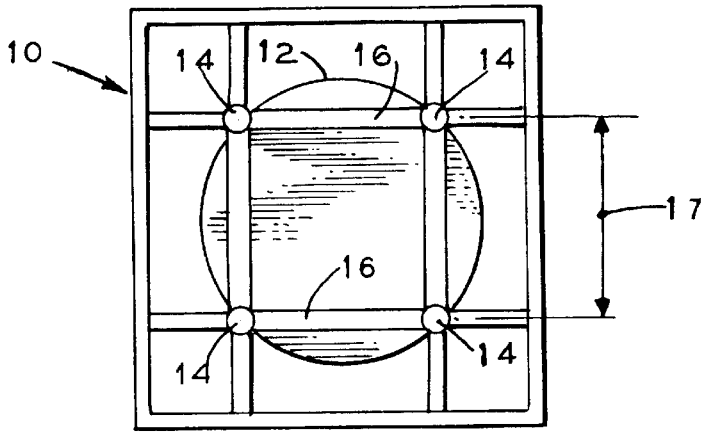
FIG. 3 is a plan view of the four legged deck supported on a circular spar vessel.

Typical orthogonal framing for a four-legged deck 10 is shown in FIGS. 1, and 2. The framing system for a spar vessel 12 delivers all of the deck load to four legs 14 located at the corners of a square 16 inscribed in the spar vessel 12 cylindrical shell as seen in FIG. 3. Thus, the spar vessel diameter determines the deck leg spacing 17.

FIGS. 4 and 5 show a transport barge 18 joined to a spar vessel 12 with a marine connector 20 such as that described in U.S. application filed on Jul. 31, 1997 and assigned Ser. No. 08/903,776. The transport barge 18 may be a launch barge and is provided with a wedge 23 on the stern rake that replaces the rocker arms normally present on a launch barge. The toggle nose 24 of the marine connector is built into the aft end of the wedge 23. The toggle nose receiver 26 is attached to the spar vessel 12 with connection plates 28. It should be understood that the toggle nose 24 may be mounted on the bow of the transport barge and that a launch barge is not necessarily indicated since any barge with sufficient stability and strength may be used.

FIG. 6 is a cross section through the skid girder 30 seen in FIGS. 4 and 5. Attached to the bottom of the skid girder 30 is a resilient runner 32 which may be formed from a piece of solid rubber 34 with steel plates 36 bonded to the top and bottom sides of the rubber. Sandwiched between the resilient runner 32 and the bottom of the skid girder bottom flange is a wood runner 38. The function of the wood will be explained below. The bottom steel plate is the actual skidding surface.

FIGS. 4 and 5 show the deck 10 skidded partway between the transport barge 18 and the spar vessel 12. As shown, the mid-span region of the skid girder 30 is located over the transverse pin of the marine connector 20. Relative pitch between the vessels causes the top surface of the marine connector 20 to kink down, as seen in FIG. 4, and to kink up, as seen in FIG. 5. The magnitude of the pitch is exaggerated to illustrate the problem solved by the resilient runner. The kinking would alternately crush the ends and then the middle of the skidding surface on the skid girder leading edge after a few cycles to failure. The resilient runner can distort to accommodate the cyclical kinking without damage.

Figure 7:
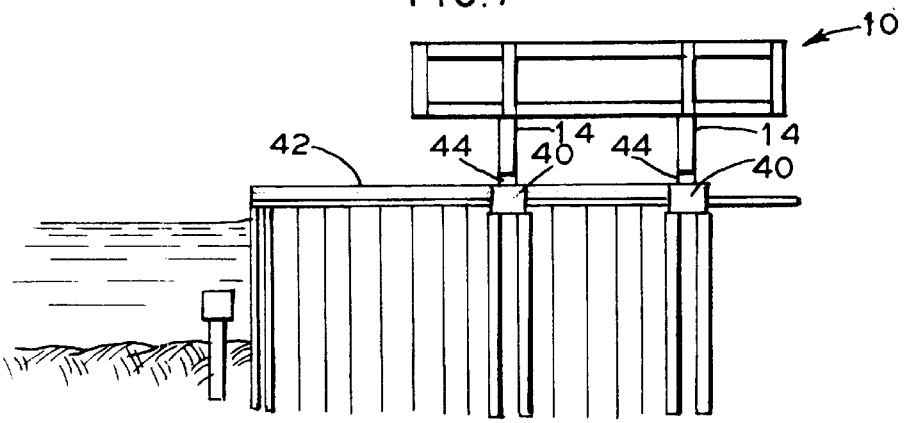
FIG. 7 is an elevation of the deck and its support system while being fabricated onshore.
Figure 8:
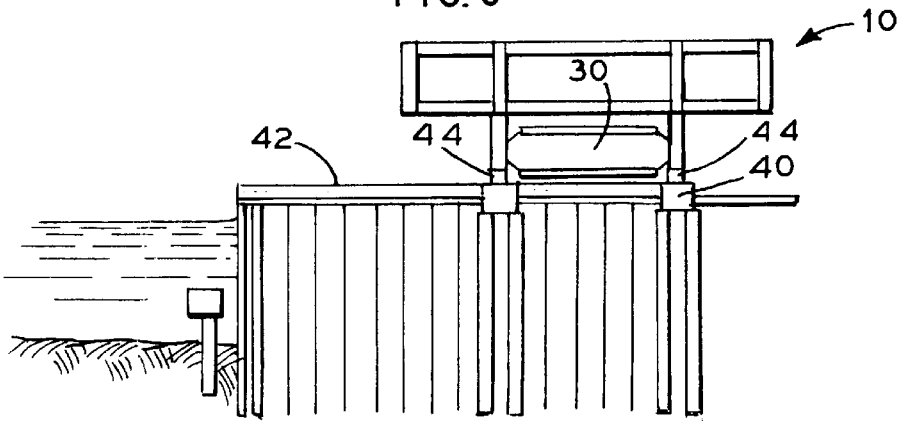
FIG. 8 is an elevation of the deck in the fabrication yard after the skid girders have been installed between the deck legs.

The platform deck 10 is fabricated onshore in one piece as shown in FIG. 7. The highly concentrated loading from the four deck legs 14 require a significant foundation system to fabricate and load out the deck 10, indicated as pile supported caps 40 and load out ways 42. During fabrication the deck legs 14 are supported on cups 44 that bear on the pile caps 40. "Cups" are a term of art in the offshore construction industry used to indicate short sections of steel pipe with a diameter approximately equal to the deck legs 14. The cups 44 support the deck 10 during most of the fabrication period. Near the end of the fabrication period, cambered skid girders 30 with the timber and resilient runners already attached beneath the skid girders 30, are welded to the deck legs 14 as shown in FIG. 8. A predetermined gap less than the height of the cups 44 is left between the resilient runners 32 on the bottom of the skid girders 30.

Figure 9:
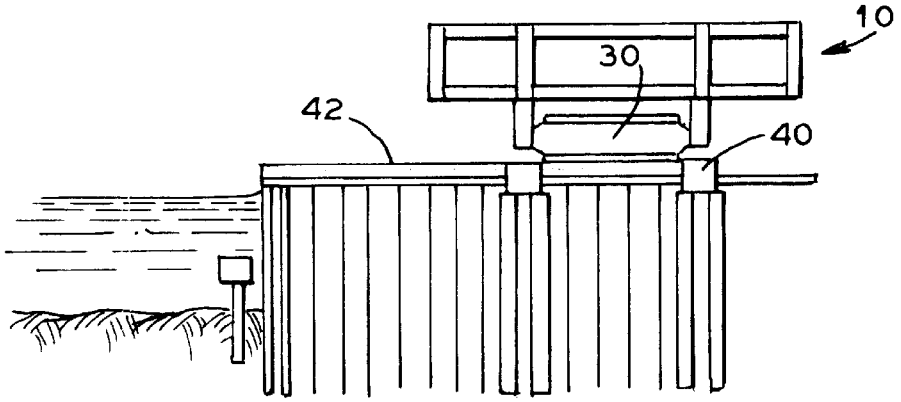
FIG. 9 is an elevation view of the deck in the fabrication yard after the deck has been lowered onto the skid girders.

As seen in FIG. 9, immediately prior to load out onto a transport barge, the cups 44 are removed to lower the deck 10 onto the skid girders 30, which are preferably cambered. The cups 44 are cut with a cutting torch in repeated circumferential passes. Each pass causes the cup to be shortened and the deck lowered by the kerf of the cut. The weight of the deck will straighten the cambered skid girder 30, resulting in a uniform compression of the resilient runners 32 along their lengths. After the cups 44 are removed, a predetermined gap is left between the bottom of the deck legs and the top of the load out ways 42.

Figure 10:
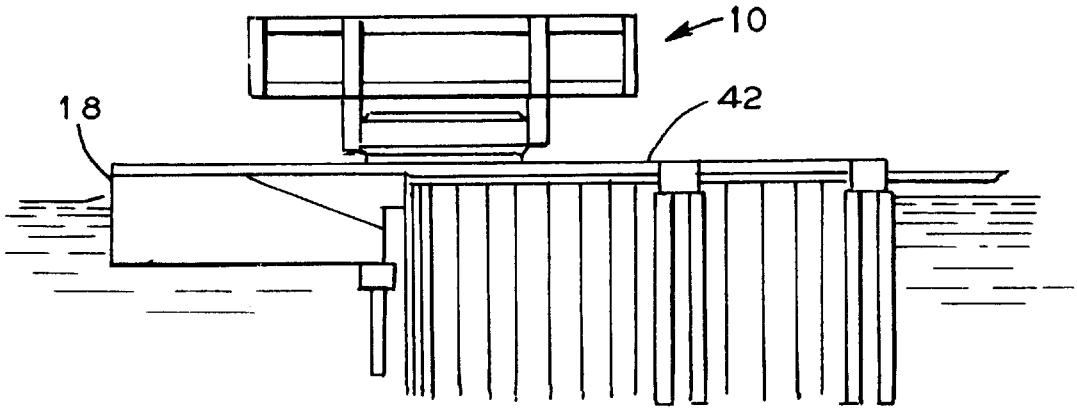
FIG. 10 is an elevation view of the deck during a skidded loadout showing the deck partially on the transport barge.

FIG. 10 illustrates the transport barge 18 in position next to the load out ways 42, with the deck 10 partly skidded onto the barge. The stern of the transport barge 18 may be grounded as shown so that only barge trim needs to be considered during the skid transfer to the barge. Alternately, a floating load out can be utilized.

Figure 11:
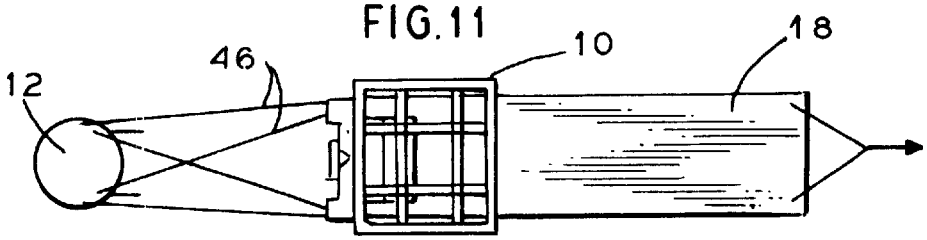
FIG. 11 is a plan view of the transport barge moored to the spar vessel in preparation for docking and connection.
Figure 12:
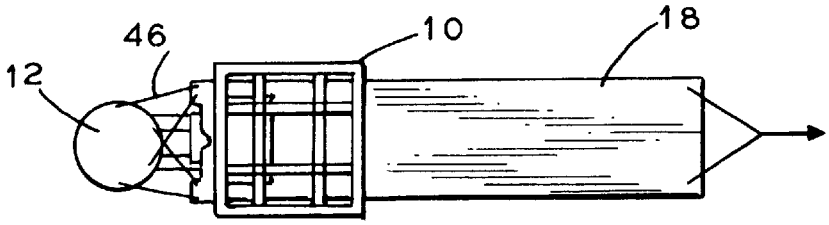
FIG. 12 is a plan view of the transport barge and the spar vessel docked, just before connection.

FIG. 11 shows the transport barge 18 rigged to the spar vessel 12 with mooring lines 46 in preparation for docking. FIG. 12 shows the transport barge 18 and the spar vessel 12 docked, just before connection. The marine connector is engaged as described in the co-pending application referred to above. This illustrates that conventional mooring systems can be utilized to dock the marine connector 20 without any special effort.

Figure 13A:
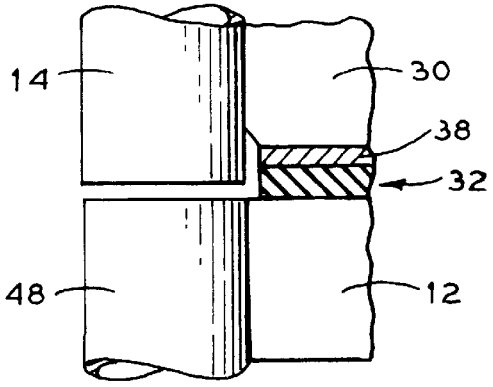
FIGS. 13A, B are elevation views detailing the lowering of the deck from its resilient skid girder runners onto the permanent deck leg supports built into the spar vessel.
Figure 13B:
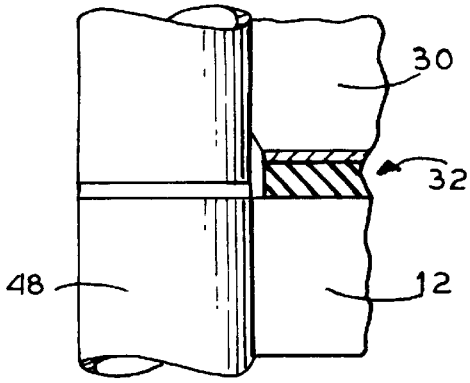

Once the transport barge 18 and spar vessel 12 are connected, the platform deck 10 is skidded on the spar vessel 12. After it is skidded to its final location the deck legs are located over receiving legs 48 that are built into the spar vessel 12. FIG. 13A illustrates the situation before the lowering of the deck 10. In order to lower the deck 10 onto the spar legs 48 and to recover the resilient runners 32, the wood runner 38 is cut away in a series of passes with a beam chain saw or a hydro-blaster. A hydro-blaster is a device that produces a fine, high-pressure jet of water that is able to cut through steel plate or pipe. After several passes the wood will be reduced enough in thickness to unload the resilient runner 32, let the camber back into the skid girders 30, and lower the deck 10 by the gap thickness. FIG. 13B illustrates the situation after the lowering of the deck 10. The resilient runner 32 may be recovered after the deck 10 has been lowered onto the spar vessel.

Figure 14:
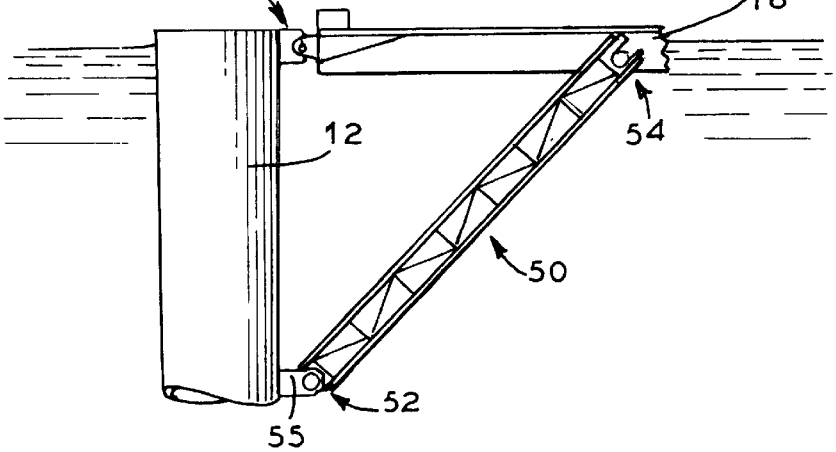
FIG. 14 is an elevation view of an alternate embodiment of the invention.
Figure 15:
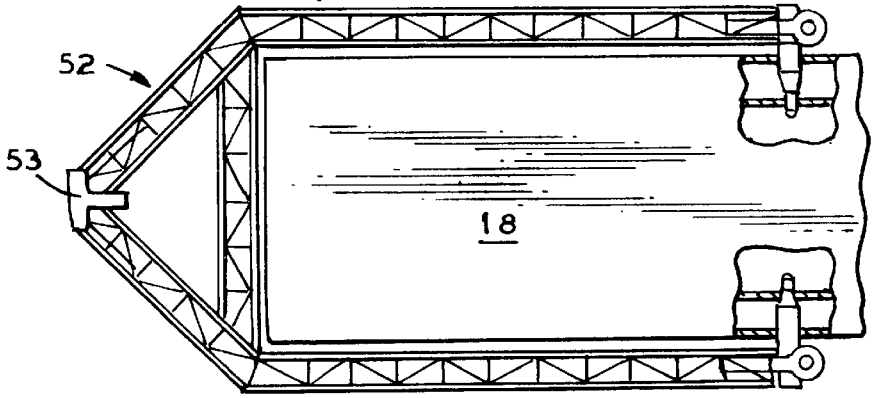
FIG. 15 is a plan view of the alternate embodiment of the invention.

FIGS. 14 and 15 illustrate an alternate embodiment of the invention where a brace 50 is installed between the transport barge 18 and the spar vessel 12 to eliminate relative pitch between the two vessels. The brace 50 has two arms that extend from midship of the transport barge 18 to about mid depth on the spar vessel 12. Since the spar vessel depth is about six hundred feet and the transport barge length is also about six hundred feet, the brace 50 is a large structure that requires special features for transport and connection.

The brace 50 has a first end 52 adapted to be connected to the spar vessel 12 and a second end 54 with each arm adapted to be connected to the transport barge 18. Connectors are provided on the spar vessel 12 and transport barge 18 and will be described below.

The first end 52 tapers to a closed end having a T-shaped connector 53 constructed of large diameter pipes as seen in FIG. 15. The transverse pipe forms the toggle nose for a marine connector such as that described in U.S. application filed Jul. 31, 1997 and assigned Ser. No. 08/903,776. The transverse pins, toggle mechanism, and hydraulic ram of the marine connector fit inside the "T". The toggle nose receiver 55 of the marine connector is joined to the spar vessel 12 while the vessel is under construction in the shipyard.

Figure 16:
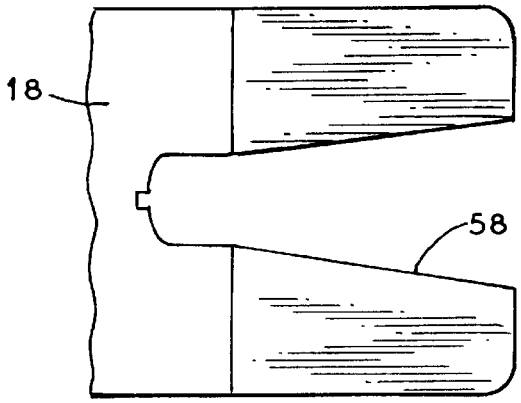
FIG. 16 is a section view through the axes of the swivel receiver for the swivel seen in FIG. 15.
Figure 17:
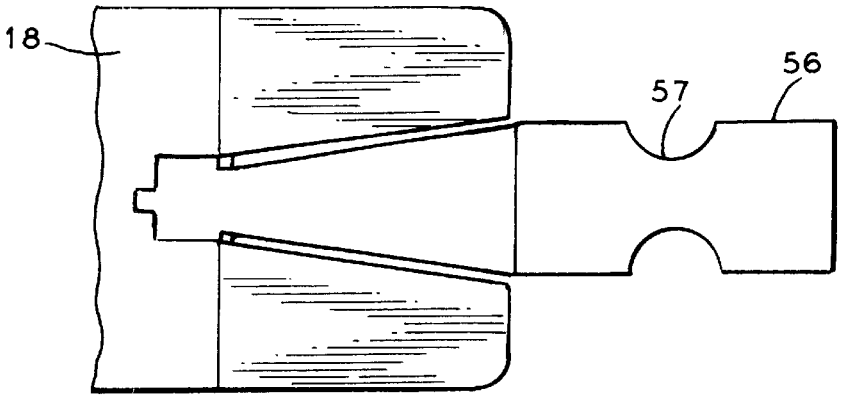
FIG. 17 is a section view through the axes of the swivel receiver and the swivel, showing the swivel seated in the receiver.

The end of each arm of the second end 54 of the brace 50 is connected to a swivel 56 mounted in a swivel receiver 58 in the transport barge 18, seen in FIGS. 15–17. The swivel receiver 58 is built into the side shell and one of the longitudinal bulkheads of the transport barge 18. Each swivel 56 is provided with a reduced diameter or saddle-shaped section 57. The swivels are readily attached and removed to allow normal barge operation when the swivels are not needed.

Figure 27:
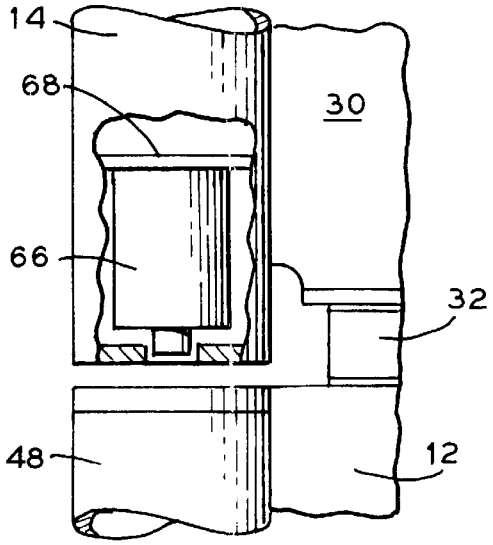
FIGS. 27–29 illustrate an alternate embodiment of the invention wherein jacks are used instead of a wood runner.
Figure 28:
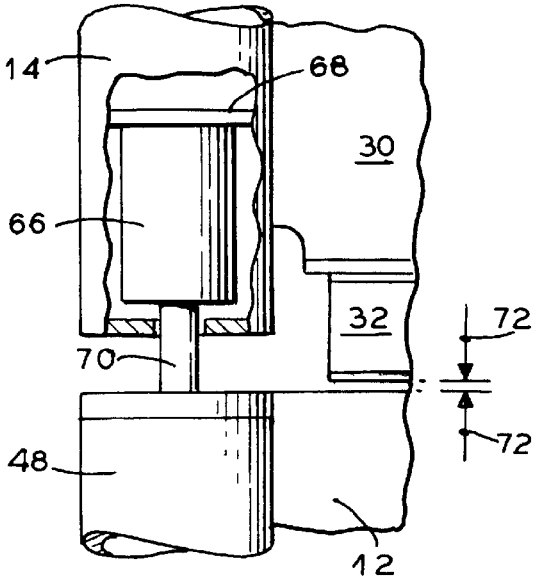
Figure 29:
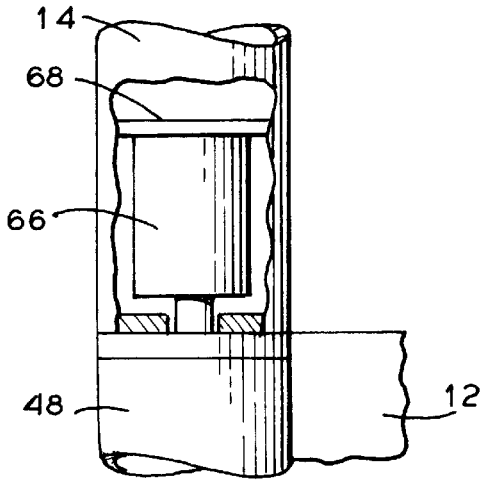

FIGS. 27–29 illustrate an alternate embodiment of the invention where a jack 66 is provided in each leg 14 of the deck 10. This eliminates the need for the wood runner 38 described above. In this embodiment, the deck 10 is skidded into its final position on the spar vessel 12 on resilient runners 32 as described above. As seen in FIG. 27, jacks 66, seen in the cutaway section of the deck leg 14, are mounted on support plates 68 in the legs 14 so that the axes of the jacks and deck legs are coincident. As seen in FIG. 28, the jacks 66 are actuated to cause the jack rams 70 to lift the deck high enough to unload the resilient runner 32 and open a gap 72 between the bottom of the resilient runner 32 and the spar vessel 12. The resilient runner 32 and skid girder 30 are removed and then the jacks 66 are used to lower the deck onto the spar vessel 12, as shown in FIG. 29. The jacks 66 are not recovered.

Figure 18:
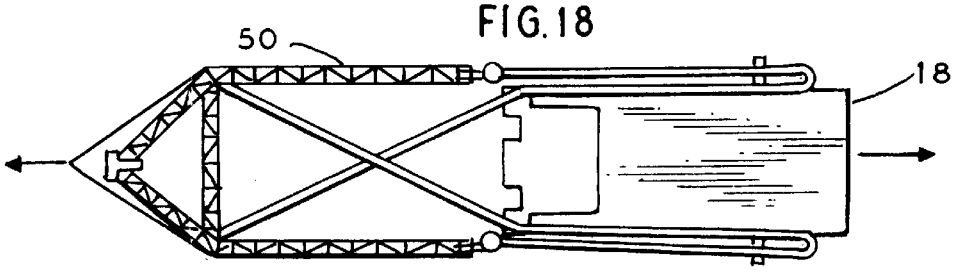
FIG. 18 is a plan view showing the rigging at the beginning of the brace installation onto the transport barge.
Figure 19:
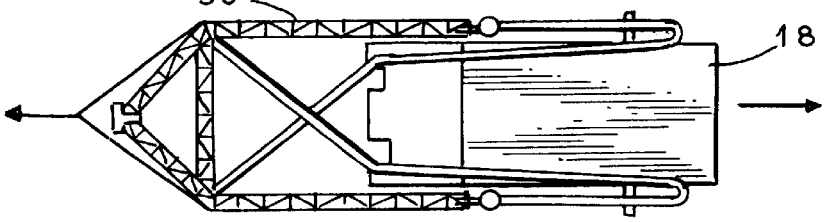
FIG. 19 is a plan view showing the rigging with the brace partly through its installation onto the transport barge.
Figure 20:
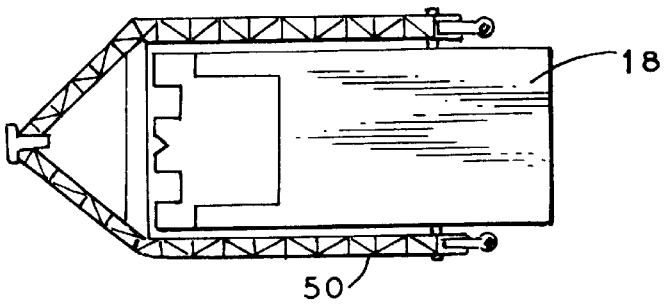
FIG. 20 is a plan view of the brace installed on the transport barge.
Figure 21:
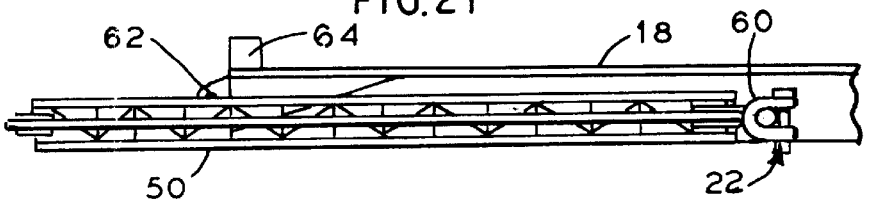
FIG. 21 is an elevation of the brace attached to the transport barge at the swivels with the brace floating in a horizontal attitude.
Figure 22:
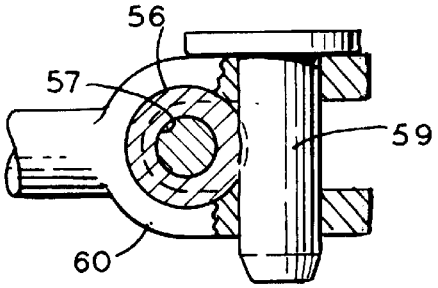
FIG. 22 is an enlarged view of the area indicated by numeral 22 in FIG. 21.

In operation, the deck 10 is skidded onto the transport barge 18 and tied down. If the brace 50 is to be used, the transport barge 18 travels to protected water for installation of the brace. FIGS. 18 and 19 illustrate the installation of the brace 50 on the transport barge 18. The brace 50 is designed to float horizontally at the waterline. Winches pull the brace into position while tugs maintain back tension on the lines. FIG. 18 shows the brace in position to be pulled along side the transport barge. FIG. 19 shows the brace partway along side the transport barge. FIGS. 20 and 21 show the horseshoe shaped brace connector 60 received around the saddle-shaped section 57 on the swivel 56. FIG. 22 shows the brace docked on the swivels and connected by lowering a stake 59 through the eyes on the ends of the horseshoe shaped brace connector 60.

Figure 23:
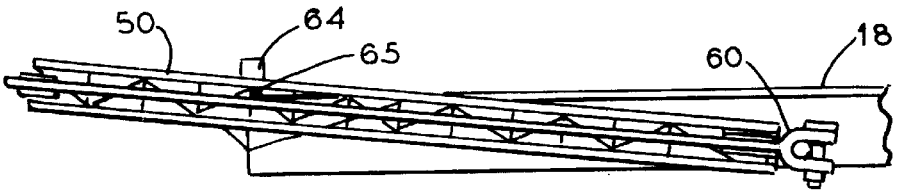
FIG. 23 is an elevation of the brace attached to the transport barge at the swivels with the brace lifted and supported near the stern in the tow attitude.

After the brace 50 is connected to the swivels 56 and is still floating horizontally, winch lines 62 are rigged to the brace 50 from the cantilever 64 provided on the barge 18, as seen in FIGS. 21 and 23. The winch lines 62 are used to lift the brace 50 until it seats on the bottom of the cantilever 64. Once lifted, a support 65 (one on each side of the barge) is swung out, and the winches lower the brace 50 a short distance onto the supports as seen in FIG. 23. The brace 50 is then tied down on the supports 65 to secure it for transport to the installation site.

Figure 24:
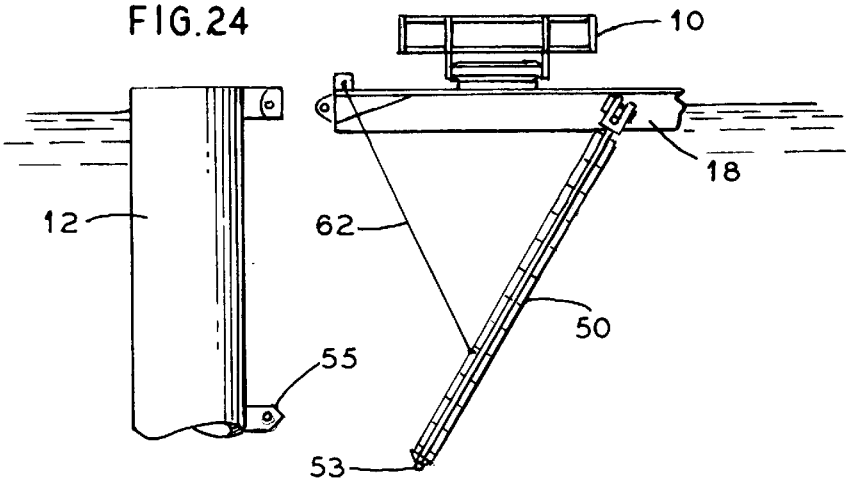
FIG. 24 is an elevation view of the transport barge approaching the spar vessel with the brace in an attitude too low for connection.
Figure 25:
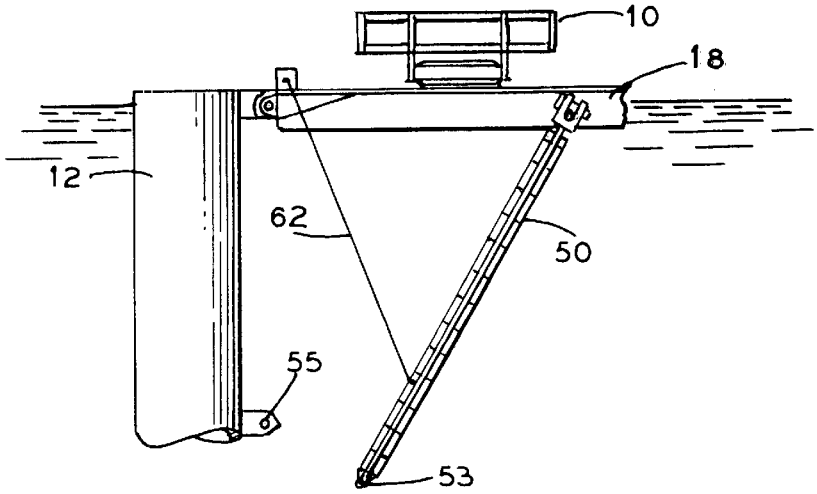
FIG. 25 is an elevation view of the transport barge joined to the spar vessel at the top connector.
Figure 26:
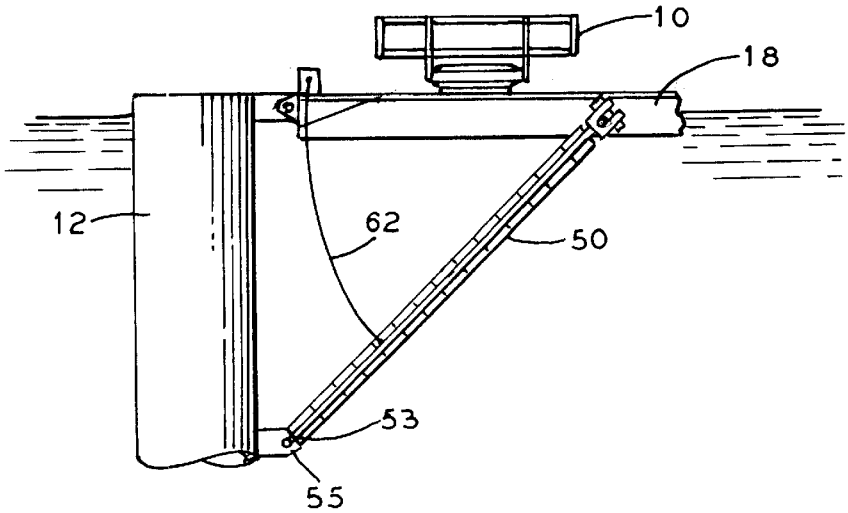
FIG. 26 is an elevation view of the transport barge with the brace attached to the spar vessel.

Once at the installation site the brace 50 is lifted slightly by the winches, the brace supports 65 are swung out of the way, and the winches lower the brace 50 into the water. Flooding chambers in the brace 50 are opened to cause the buoyancy of the brace 50 to change from neutral to slightly negative. As seen in FIG. 24, the winches and winch lines 62 then lower the brace 50 to a position lower than the position at which it will be connected to the spar vessel 12. With the brace 50 in this out of the way position the top connection at the water line is made as seen in FIG. 25. The top connection is made using the same procedures described above for the relative pitch option. The winches and winch lines 62 are used to pull the brace 50 upward until the T-shaped connector, which forms the toggle nose of the marine connector, docks in the toggle nose receiver 55 on the spar vessel 12 as seen in FIG. 26. The connection is made by operating the toggle with hydraulic lines running up the brace 50 to the transport barge 18. After the connection is made the winch lines 62 can be slacked off, leaving the configuration ready for skid on operations, as seen in FIG. 26.

The skid on operation and deck lowering operation using the brace 50 are essentially the same as the operation conducted without the brace 50 where relative pitch is allowed between the transport barge 18 and the spar vessel 12. After the skid on is completed, the brace 50 and barge 18 are disconnected by reversing the operations described above.

Although the description above refers to a spar vessel for installing a deck, it should be understood that the spar vessel is merely used as an example of a floating offshore structure and that the invention is applicable to other floating offshore structures.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for transferring a deck having a plurality of legs from a barge to a floating offshore structure, comprising the steps of:

a. connecting one end of the barge to the floating offshore structure using a connector that allows only relative pitch between the barge and floating offshore structure;

b. skidding the deck from the barge to the floating offshore structure on a resilient runner; and c. disengaging the connection between the barge and the floating offshore structure.

2. The method of claim 1, wherein:

a. the legs of the deck are supported a predetermined distance above the surface of the barge by a skid girder welded to the legs of the deck; and b. a removable runner is provided on the skid girder and positioned above the resilient runner for lowering the deck legs to the surface of the floating offshore structure once the transfer is complete.

3. A method for loading a deck having a plurality of legs onto a barge and transferring the deck from the barge to a floating offshore structure, comprising the steps of:

a. providing removable cups on the bottom of each leg of the deck;

b. attaching a skid girder to the legs of the deck such that, with said skid girder having a removable runner attached to the bottom surface of the skid girder and a resilient runner attached to the bottom surface of the removable runner, and said skid girder being positioned such that said resilient runner is a predetermined distance above the surface on which the removable cups rest;

c. removing the removable cups such that the skid girder and resilient runner support the deck and the deck legs are at a predetermined distance above the surface on which the skid girder rests;

d. skidding the deck onto the barge;

e. transporting the barge adjacent a floating offshore structure and connecting the barge to the floating offshore structure using a connector that allows only relative pitch between the barge and floating offshore structure; and f. skidding the deck onto the floating offshore structure;

g. removing the removable runner from the skid girder such that the deck legs support the deck on the floating offshore structure.

4. The method of claim 3, wherein the removable runner is formed from wood.

5. The method of claim 3, wherein the resilient runner is formed from rubber sandwiched between steel plates.

6. A method for transferring a deck having a plurality of legs from a barge to a floating offshore structure, comprising the steps of:

a. connecting one end of the barge to the floating offshore structure using a connector that allows only relative pitch between the barge and floating offshore structure;

b. connecting a brace from the barge to the floating offshore structure at a predetermined depth on the floating offshore structure such that the two-point connection formed by the connector and brace prevents relative pitch between the barge and the floating offshore structure;

c. skidding the deck from the barge to the floating offshore structure; and d. disengaging the connections between the barge and the floating offshore structure.

7. The method of claim 6, wherein:

a. the legs of the deck are supported a predetermined distance above the surface of the barge by a skid girder welded to the legs of the deck;

b. a removable runner is provided on the skid girder for lowering the deck legs to the surface of the floating offshore structure once the transfer is complete.

8. The method of claim 6, wherein the brace attaches to the barge using a swivel connection.

9. A method for loading a deck having a plurality of legs onto a barge and transferring the deck from the barge to a floating offshore structure, comprising the steps of:

a. providing removable cups on the bottom of each leg of the deck;

b. attaching a skid girder to the legs of the deck, with said skid girder having a removable runner attached to the bottom surface of the skid girder and a resilient runner attached to the bottom surface of the removable runner, and said skid girder being positioned such that said resilient runner is a predetermined distance above the surface on which the removable cups rest;

c. removing the removable cups such that the skid girder and resilient runner support the deck and the deck legs are at a predetermined distance above the surface on which the skid girder rests;

d. skidding the deck onto the barge;

e. transporting the barge adjacent a floating offshore structure;

f. connecting the barge to the floating offshore structure using a connector that allows only relative pitch between the barge and floating offshore structure;

g. connecting a brace from the barge to the floating offshore structure at a predetermined depth on the floating offshore structure such that the two-point connection formed by the connector and brace prevents relative pitch between the barge and the floating offshore structure;

h. skidding the deck from the barge to the floating offshore structure;

i. removing the removable runner from the skid girder such that the deck legs support the deck on the floating offshore structure; and j. disengaging the connections between the barge and the floating offshore structure.

10. The method of claim 9, wherein the removable runner is formed from wood.

11. The method of claim 9, wherein the brace attaches to the barge using a swivel connection.

* * * * *